United States Patent [19]

Slautterback

[11] Patent Number: 4,479,590

[45] Date of Patent: Oct. 30, 1984

[54] HIGH VISCOSITY MATERIAL MELTING AND DISPENSING APPARATUS

[75] Inventor: Fred A. Slautterback, Carmel Valley, Calif.

[73] Assignee: Slautterback Corporation, Monterey, Calif.

[21] Appl. No.: 370,600

[22] Filed: Apr. 21, 1982

Related U.S. Application Data

[63] Continuation-in-part of Ser. No. 291,554, Aug. 10, 1981, abandoned.

[51] Int. Cl.[3] ..... B67D 5/62

[52] U.S. Cl. ..... 222/146.5; 222/236; 366/279; 366/289

[58] Field of Search ..... 222/146 HE, 226, 227, 222/228, 236, 238, 239, 240, 241, 242, 252, 254, 290, 408, 415; 366/279, 399; 414/306, 327; 219/421; 126/343.5, 343 R, 343 A

[56] References Cited

U.S. PATENT DOCUMENTS

| | | | |
|---|---|---|---|
| 1,422,811 | 7/1922 | Applegate | 165/139 |
| 1,859,290 | 5/1932 | Davis | 222/227 X |
| 2,174,319 | 9/1939 | Gastrow | 18/55 |
| 2,495,671 | 1/1950 | Cellwork | 222/252 |
| 2,585,767 | 2/1952 | Guggenheim et al. | 259/108 |
| 2,773,629 | 12/1956 | Miller | 222/226 |
| 2,778,922 | 1/1957 | Birkner, Jr. | 219/44 |
| 2,782,963 | 2/1957 | Erdmenger | 222/227 |
| 3,193,155 | 7/1965 | Hazen | 222/227 |
| 3,229,665 | 1/1966 | Baltz | 119/52 |
| 4,059,466 | 11/1977 | Scholl et al. | 222/146 HE |
| 4,096,973 | 6/1978 | Checko | 222/146 HE |
| 4,184,779 | 1/1980 | Detmer | 366/282 |
| 4,186,852 | 2/1980 | Braga | 222/146 HE |
| 4,236,654 | 12/1980 | Mello | 222/238 |

FOREIGN PATENT DOCUMENTS 578393 10/1977 U.S.S.R. .

*Primary Examiner*—H. Grant Skaggs
*Assistant Examiner*—Michael S. Huppert
*Attorney, Agent, or Firm*—Thomas Schneck

[57] ABSTRACT

Apparatus for melting and dispensing very high viscosity material, such as butyl. A chamber with heated walls is provided with an internal conveyor and pump near the bottom wall of the chamber. The conveyor has sections which transfer rotational energy to material within the chamber, dragging high viscosity material to a pump inlet hole in the bottom wall of the chamber. Deflection plates mounted within the chamber push material down onto the conveyor, so that pump suction can be maintained. The plates also promote vertical as well as horizontal material mixing, thereby exposing new surfaces of the thermoplastic material to the heated walls of the chamber, increasing the rate of heat transfer from the walls to the material.

14 Claims, 5 Drawing Figures

HIGH VISCOSITY MATERIAL MELTING AND DISPENSING APPARATUS

CROSS REFERENCE TO RELATED APPLICATION

This application is a continuation-in-part of prior application Ser. No. 291,554 filed Aug. 10, 1981, now abandoned, for HOT MELT MATERIAL MELTING AND DISPENSING APPARATUS.

TECHNICAL FIELD

This invention relates to apparatus for melting and dispensing very high viscosity hot-melt material, such as low heat transfer rate thermoplastics, particularly sealants and adhesives, such as butyl.

BACKGROUND ART

It is well known that the viscosity of the thermoplastic material decreases with increases in temperature and pressure. In the field of hot-melt adhesives, small masses of thermoplastic material, solid at room temperature, are placed in a heating unit wherein walls of the unit transfer heat to the thermoplastic material melting it. In U.S. Pat. No. 3,964,645 thermoplastic material is introduced through the top of a hopper, heated in a lower receptacle which is fed by the hopper and then removed by a pump at the bottom of the receptacle. The success of this apparatus is partially due to the fact that there is adequate heat transfer from the walls of the receptacle to the thermoplastics to the extent that acceptable flow characteristics are obtained in the material. There are some very high viscosity thermoplastic materials, such as butyl, for which there is inadequate heat transfer from the walls of prior art melt units. For such substances, the melt time is unacceptably long, namely a few hours.

In Russian patent SU-578393 there is a teaching of electrical heating units which are hinged in rows to the walls of a chamber. These hinged heating units initially line the walls of the chamber and are intially in a flat position. Upon loading lumps of a material to be melted, the heaters are switched on and lifted, increasing heat transfer. Simultaneously, the melt is stirred by a propeller.

In the field of thermoplastic injection molding, it is known that granular thermoplastic materials can be melted more readily by agitating the granular material while heating. For example, in U.S. Pat. No. 2,174,319 agitation is applied to a heating receptacle by circulating spokes. Various types of paddles, vanes and blades are known in the prior art for the purpose of stirring. However, the problem for high viscosity thermoplastic materials is that such blades encounter too much resistance for effective operation.

An object of the invention was to devise an efficient heat transfer unit for melting and dispensing high viscosity hot-melt material, such as thermoplastics.

DISCLOSURE OF INVENTION

The above object has been met by providing a heated wall chamber with a material conveyor having linear sections disposed near the bottom wall of the chamber. The conveyor has spans sufficiently long and powerful for driving a mass of thermoplastic material which is initially either solid or nearly solid. The conveyor extends in a loop and imparts motion which is initially cylindrically rotational, but eventually becomes vertically rotational as well, as deflection plates mounted within the chamber push the material downwardly onto the conveyor. This mixing action promotes increased heat transfer from the heated chamber walls to the material, as new material surfaces are continually exposed to the heated walls. To provide even greater mixing, short upwardly extending vanes or teeth may be attached to the conveyor for increasing traction with respect to the mass of initially solid thermoplastic material. The viscosity of thermoplastic material is greatly decreased by motion of the conveyor, compared to the situation where no conveyor is used.

BEST MODE FOR CARRYING OUT THE INVENTION

Figure 2:
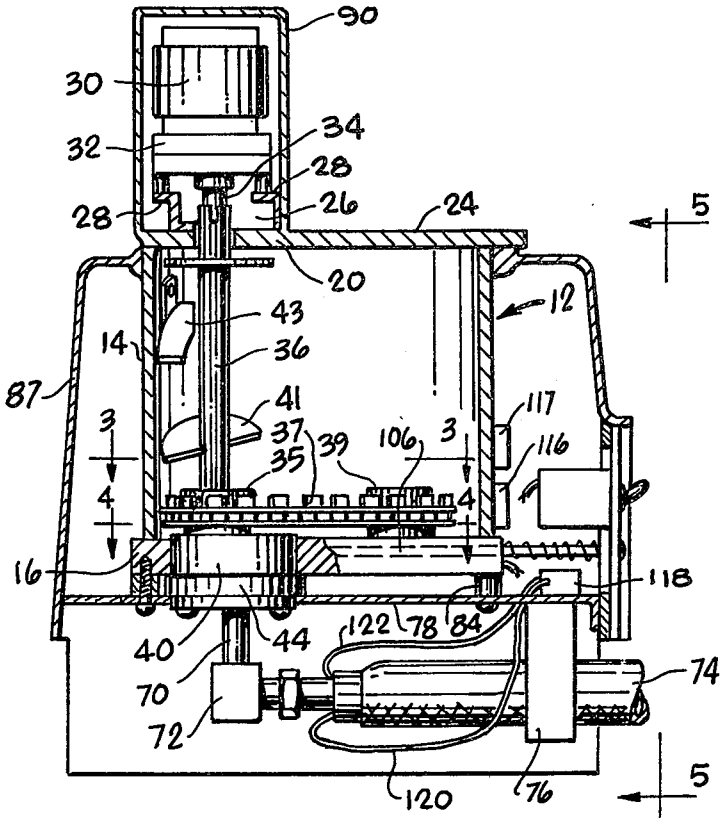
FIGS. 1 and 2 are side sectional views of a material melting-and-dispensing apparatus of the present invention.
Figure 1:
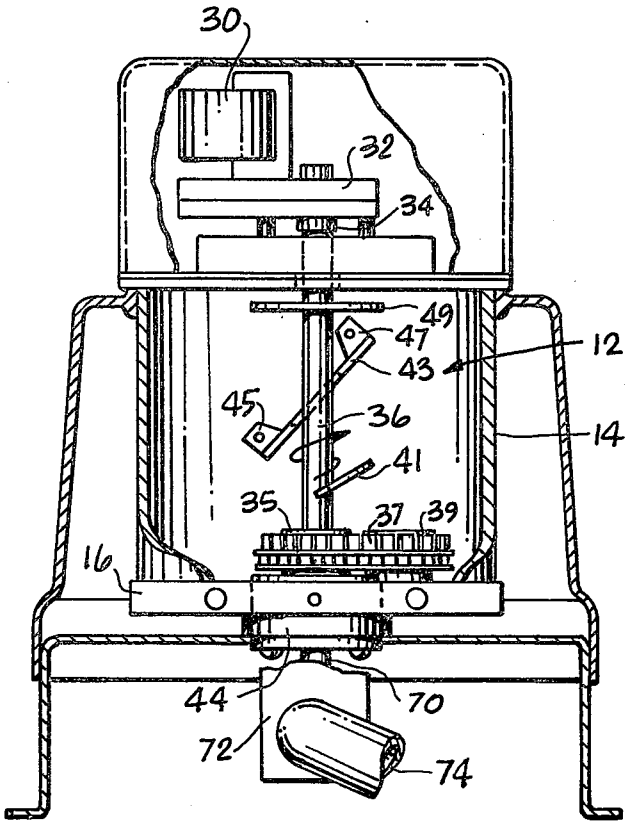

With reference to FIGS. 1 and 2, chamber 12 is a hollow tank for containing high viscosity thermoplastic material to be melted and dispensed. Chamber 12 has a side wall 14 of generally cylindrical form and a bottom wall 16 which cooperates with the side wall to form an impervious chamber. Side wall 14 and bottom wall 16 are constructed of aluminum or like material of high heat conductivity. The tank can be formed by welding bottom wall 16 to the lower edge of side wall 14 or the two can be cast in one integral structure.

Extending across a portion of the top of tank 12 is a rigid support plate 20, forming part of a top wall, which is fastened to the upper edge of side wall 14. The support plate is truncated at a diametrically extending edge so as to define a hinged port 24 which affords introduction of material into chamber 12. Fastened to the upper surface of support plate 20 is a bracket 26 which has horizontal flanges 28 that are spaced above the top surface of support plate 20. Secured to flanges 28 is a motor drive assembly which includes an electric motor 30 having a shaft, not shown, that drives a speed-reducing gear box 32. Speed-reducing gear box 32 has an outlet shaft 34 that extends downward. Coupled to shaft 34 is a main drive shaft 36 which extends vertically into chamber 12. Bracket 26 and support plate 20 are apertured to admit drive shaft 36 therethrough.

Shaft 36 has a bottom end with a pulley or gear 35 proximate to the bottom wall of chamber f12 for driving a conveyor means 37 which may be a chain or belt. The conveyor means has linear sections, which may have vanes as shown in the conveyor means 37 of FIGS. 1 and 2 for increasing traction on the mass, and is trained about at least one other gear or pulley 39 for forming a loop. The purpose of the conveyor means is to impart motion to a mass of solid or partially solid thermoplastic material which is loaded into chamber 12. High viscosity materials which do not easily melt because of insufficient heat transfer through the mass will have new surfaces exposed to the heated walls of the chamber by this motion. Some softening of the thermoplastic material may be required prior to rotation of shaft 36 if the material is tightly packed into the chamber or re-solidified from prior use and subsequent cooling. However, once shaft 36 is able to rotate and drive conveyor 37, thermoplastic material viscosity rapidly decreases as the material is mixed, both laterally and vertically. Heat may be transmitted to the viscous mass through shaft 36, although most heat comes from wall surfaces. Lateral mixing occurs due to conveyor lateral motion, since the conveyor is generally in a plane parallel to the bottom wall of the chamber. Only a fraction of the mass of the material is supported by the conveyor. However, once the conveyor is in operation motion is imparted to the entire material mass. Thus, the conveyor must have sufficient length to accomplish this task and must have sufficient power to drive the mass.

Because of inertia, the mass may tend to resist motion of the conveyor and move up and away therefrom. To avoid this situation a deflection means is provided comprising plates which push the material downwardly. A first angularly inclined plate 41 is mounted on shaft 36 approximately one-third the distance from the bottom wall to the top wall of the chamber. Plate 41 resembles half of a disk and serves to provide material deflection, as well as promoting mixing. Plate 41 imparts a pulsating motion to the mass which eliminates breaking of the pump's suction during constant operation of the device, especially when chamber 12 is low. Plate 41 has been found to be important, but not critical, in maintaining mass flow for high viscosity masses. A second deflection plate 43 is also angularly inclined in a direction for pushing the rotating mass of thermoplastic material downward onto the material conveyor. The second deflection plate 43 is fixed to side wall 14 by means of brackets 45 and 47. A third material deflection plate 49 is an annular plate fixed to shaft 36 near the upper end thereof, keeping thermoplastic material from pushing against the shaft exit aperture in the chamber. The plates push thermoplastic material downwardly toward the conveyor location. This achieves vertical mixing of the material accompanying the horizontal mixing.

In vertical alignment with shaft 36, bottom wall 16 is bored to receive an upstanding cylindrical portion 40 of a housing of a gear pump 42. The housing has an integral base portion 44. There is a gasket between the upper surface of base portion 44 and the lower surface of bottom wall 16 so as to form a liquid-tight joint therebetween, the gasket and lower portion 44 having mounting holes to accommodate mounting screws which retain pump 42 in bottom wall 16.

Figure 3:
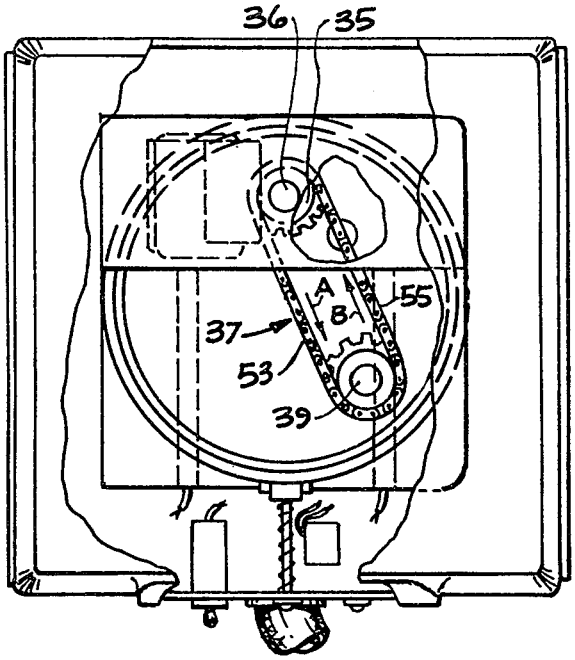
FIG. 3 is a top cutaway detail taken along 3—3 in FIG. 2.

With reference to the top view of FIG. 3, the first gear or pulley 35 may be seen in relation to shaft 36. The conveyor means 37 is seen to be a chain having lengthwise sections 53 and 55 travelling in opposite directions indicated by arrows A and B. The conveyor means 37 is trained about the gear 39 for completing a loop. The pulley or gear 35 is connected to a underlying gear which drives a gear pump. The conveyor means 37 terminates at one end near an inlet hole of the pump.

Figure 4:
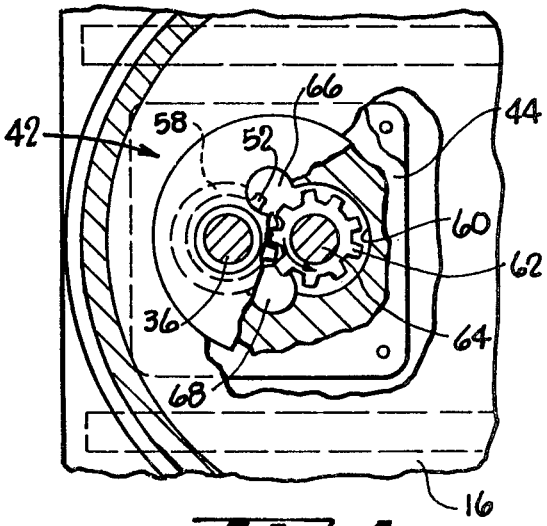
FIG. 4 is a top, partial cutaway of a detail taken along lines 4—4 in FIG. 2.

Referring to FIG. 4, gear pump 42 includes gear 52 underlying gear or pulley 35. Gear 52 is coupled to drive shaft 36 so as to be rotatively driven thereby in response to energization of motor 30. Interior of cylindrical housing portion 40 of the gear pump, gear 52 is constrained for rotation within a pump chamber that has a cylindrical portion 58 concentric with the axis of rotation of gear 52.

The pump chamber also has a second cylindrical portion 60 offset from cylindrical portion 58. Mounted for rotation within cylindrical portion 60 is a gear 62 supported on an idler shaft 64. The teeth on gear 62 mesh with the teeth on gear 52 so that the former is driven by the latter. There is a clearance space between the radial extremities of the gear teeth and the cylindrical chambers in which they rotate so that they can rotate even when no material is being discharged. Bottom wall 16 defines an aperture 66 which registers with a pump inlet port location on one side of the region of engagement between gears 52 and 62. The inlet port, as well as all material passages, should be wide enough to accommodate very viscous material without building up significant back pressure. An outlet port 68 is formed in base portion 44 at a site on the opposite side of the region of engagement between the gears. The lower portion of outlet port 68 is internally threaded to receive an outlet fitting.

Returning to FIGS. 1 and 2, outlet fitting 70 is connected to a 90° elbow fitting 72 to which is connected a heated hose 74 which is of conventional form and which has an opposite end that can be coupled to a suitable hot-melt or other applicator, such as a trigger operated gun. Adjacent to the front edge of the apparatus is a hose bracket 76 which depends from a base plate 78. Base plate 78 has on two opposite edges thereof integral supporting legs which support the apparatus above a horizontal surface so as to accommodate fittings 70 and 72, hose 74 and bracket 76. Additionally, there are hollow spacers 84 for spacing heated bottom wall 16 of chamber 12 above base plate 78. Screws extend through suitably positioned holes in base plate 78 and the hollow centers of spacers 84 into tapped holes in the bottom of tank wall 16 to fix the tank onto the base plate.

There is substantial area of bottom wall exposed for direct contact by hot-melt material and consequent efficient melting thereof.

The viscous materials to be transported out of the pump chamber are dragged or carried to the pump inlet hole by the conveyor means. Very viscous materials usually have high self adhesion so that once the material starts to be pulled, remaining material will follow.

Surrounding the previously described elements is a casing generally indicated at 87. Casing 87 is constructed of reinforced fiberglass or like material with good insulating properties so as to protect persons using the apparatus from injury. Extending upward from casing 87 is a motor casing 90 which encases motor 30, gear box 32 and mounting bracket 26 to protect those elements from injury and to prevent inadvertent contact with such elements.

Figure 5:
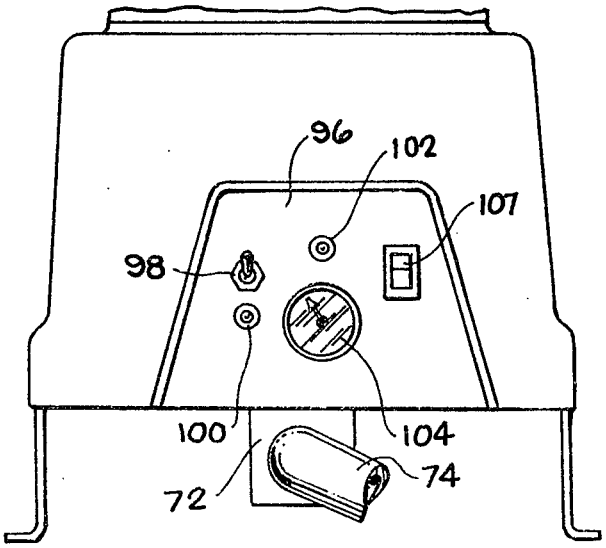
FIG. 5 is a partial side elevation, taken along lines 5—5 in FIG. 2.

Accessible from the front surface of casing 87 is a control panel 96 which may be viewed in FIG. 5. Mounted on the control panel for access by the user from the exterior of the apparatus is a power switch/circuit breaker 98, a power-on signal light 100, and an over temperature signal light 102. Also mounted on control panel 96 is a thermometer 104 that has a probe which extends into a suitably located horizontally extending bore in the chamber bottom wall to afford an indication of the temperature of the bottom wall and therefore of the hot melt material within tank 12. In addition, there is a pump motor switch 107.

Returning to FIG. 2, in flanking relation to the bore in bottom wall 16 for thermometer probe 106 are relatively larger bores in which are mounted electric cartridge heaters, not shown. The cartridge heaters, when energized, heat bottom wall 16 and heat energy is conveyed to side wall 14 and the hot-melt material disposed in chamber 12.

Mounted in heat conducting relation to the exterior surface of side wall 14 is a temperature controller 116 which is a conventional element having a pair of contacts that open or break when the temperature of chamber 12 and the hot-melt material contained therein reach a preset temperature. An over temperature switch 117 is also mounted to tank side wall 14; the over temperature switch has a pair of contacts that open in the event of excessive tank temperature to disconnect power to the cartridge heaters.

The temperature within hose 74 is also controlled and for this purpose there is a temperature controller 118 mounted on base plate 78. The input to temperature controller 118 is by a capillary tube 120 which terminates in a bulb that is disposed within the sheath of hose 74 outward of the apparatus, the pressure in capillary tube 120 being proportional to the temperature sensed by the bulb. The output of temperature controller 118 is by a power line 122 which applies power to a resistance heating element that is wrapped around hose 74 throughout its length. Thus power is applied to hose 74 when the temperature sensed by the bulb associated with capillary tube 120 is below a given set point, and power is interrupted when the temperature is above such set point.

In operation, cover 24 is pivoted to an open position and high viscosity thermoplastic material is introduced into chamber 12. The material is typically in pellets or chunks of a size sufficient to pass through the opening of the top of chamber 12. Heaters are energized so as to heat bottom wall 16, side wall 14 and the thermoplastic material in chamber 12. When the material has reached a suitable temperature as read from thermometer 104, motor switch 98 can be activated to energize pump motor 30. Because of the speed reduction afforded by gear box 32 and because of the substantial clearance in pump 42 between the gears and the cylindrical chambers in which they rotate, the pump motor can operate without overload even when no material is being dispensed through hose 74.

Once shaft 36 begins to rotate after the pump motor is energized, the conveyor means 37 becomes operative, together with the material deflectors, thereby promoting material mixing to speed reduction in material viscosity to a condition where the material will readily flow in the heated pipe. When the applicator at the free end of hose 74 is opened, the material is discharged through fittings 72 and 74 to the hose. Because the hose has a resistance heating element therein, the heated material is at proper temperature when it reaches the applicator.

The pump 42 should be of a type which can be stalled for long periods of time without damage to the windings. By providing an electrical impedance ahead of the motor, power can be dissipated outside of the windings.

Because motor 30 is mounted substantially within upward projection of tank 12 and because drive shaft 36 extends through the tank, the apparatus is extremely compact.

I claim:

1. Apparatus for melting and dispensing high viscosity thermoplastic material of the type having a chamber with heated walls, a bottom wall defining an exit port, a top wall defining a material entry port, the improvement comprising, a conveyor having lengthwise sections disposed in a plane substantially parallel to the bottom wall of the chamber for imparting lateral rotary mixing motion to a mass of thermoplastic material loaded in said chamber, said conveyor having an end proximate to a chamber exit port, and deflection means disposed in the chamber for directing material downward onto said conveyor sections, said deflection means comprising an angularly inclined first plate mounted on a rotating shaft projecting through the chamber wall, said shaft driving said conveyor sections.

2. The apparatus of claim 1 wherein said deflection means further comprises an angularly inclined second plate mounted on a side wall of said chamber.

3. The apparatus of claim 1 further comprising a gear driven pump communicating with the exit port, said conveyor driven by a shaft connected to a pulley mounted on the bottom wall, said conveyor trained about said pulley and said gear.

4. Apparatus for melting and dispensing high viscosity thermoplastic material comprising, a walled chamber with means for heating wall surfaces of the chamber, a wall surface defining a material entry port, a bottom wall defining a material exit port, a pump communicating with said exit port, and a material conveyor means having linear sections disposed in a plane substantially parallel to the bottom wall of the chamber for imparting lateral rotary mixing motion to a mass of thermoplastic material loaded in said chamber, said conveyor means having an end proximate to said material exit port, deflection means disposed in the chamber for directing material downward onto said conveyor sections, said pump being driven by a gear and said conveyor being driven by a shaft connected to said gear said conveyor trained about said gear and a pulley mounted on the bottom wall.

5. Apparatus for melting and dispensing high viscosity thermoplastic material comprising, a walled chamber with means for heating wall surfaces of the chamber, a wall surface defining a material entry port, a bottom wall defining a material exit port, a pump communicating with said exit port, a material conveyor means having linear sections disposed in a plane substantially parallel to the bottom wall of the chamber for imparting lateral rotary mixing motion to a mass of thermoplastic material loaded in said chamber, said conveyor means having an end proximate to said material exit port, and deflection means disposed in the chamber for directing material downward onto said conveyor sections, said deflection means comprising an angularly inclined first plate mounted on a rotating shaft projecting through the chamber wall, said shaft driving said conveyor sections.

6. The apparatus of claim 5 wherein said deflection means further comprises an angularly inclined second plate mounted on a side wall of said chamber.

7. Apparatus for melting and dispensing high viscosity thermoplastic material comprising, a walled chamber with means for heating wall surfaces of the chamber, a wall surface defining a material entry port, a bottom wall defining a material exit port, a material conveyor means having linear sections disposed in a plane substantially parallel to the bottom wall of the chamber for imparting lateral rotary mixing motion to a mass of thermoplastic material loaded in said chamber, said conveyor means having an end proximate to said material exit port, and a gear driven pump communicating with the exit port, said conveyor driven by a shaft connected to said gear, said conveyor trained about a pulley on said shaft and a second pulley, both pulleys mounted proximate to the bottom wall.

8. The apparatus of claim 7 wherein said conveyor sections comprise links of a chain.

9. The apparatus of claim 8 wherein said links have vanes connected thereto.

10. The apparatus of claim 7 further defined by deflection means disposed in the chamber for directing material downward onto said conveyor sections.

11. The apparatus of claim 7 wherein said deflection means comprise an angularly inclined first plate mounted on a rotating shaft projecting through the chamber wall, said shaft driving said conveyor sections.

12. The apparatus of claim 11 wherein said deflection means further comprises an angularly inclined second plate mounted on a side wall of said chamber.

13. Apparatus for melting and dispensing high viscosity thermoplastic material comprising, a walled chamber with means for heating wall surfaces of the chamber, a wall surface defining a material entry port, a bottom wall defining a material exit port, a material mixing means comprising lengthwise sections forming a loop disposed in a plane substantially parallel to the bottom wall of the chamber for imparting both lateral and vertical rotation to a mixture of solid and melted thermoplastic material loaded in said chamber, a pump communicating with said exit port, said pump driven by a gear and said loop rotated by a shaft connected to said gear, said loop trained about a pulley on said shaft and a second pulley, both pulleys mounted proximate to the bottom wall.

14. Apparatus for melting and dispensing high viscosity thermoplastic material compring, a walled chamber having a top, a bottom and sides, with means for heating at least the bottom and sides of the chamber, said chamber having a material exit port near the bottom of the chamber and a pump communicating with the exit port, a power driven chain loop near the bottom of the chamber for imparting lateral mixing motion to thermoplastic material in said chamber, and a vertical power shaft extending through said chamber, said power shaft having a rotary material deflection means mounted thereon for deflecting material downward onto said chain loop, said power shaft connected to said pump near the bottom of the chamber.

* * * * *